US007541999B2

(12) United States Patent
Matsushita et al.

(10) Patent No.: US 7,541,999 B2
(45) Date of Patent: Jun. 2, 2009

(54) POLARIZATION SWITCHING/VARIABLE DIRECTIVITY ANTENNA

(75) Inventors: Akio Matsushita, Osaka (JP); Tomoyasu Fujishima, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/059,885

(22) Filed: Mar. 31, 2008

(65) Prior Publication Data

US 2009/0009417 A1 Jan. 8, 2009

Related U.S. Application Data

(63) Continuation of application No. PCT/JP2007/069756, filed on Oct. 10, 2007.

(30) Foreign Application Priority Data

Nov. 10, 2006 (JP) ..... 2006-304733

(51) Int. Cl.
*H01Q 13/00* (2006.01)

(52) U.S. Cl. ..... 343/770

(58) Field of Classification Search ..... 343/770, 343/767, 702, 741, 742, 866–868, 748
See application file for complete search history.

(56) References Cited

U.S. PATENT DOCUMENTS 4,924,237 A * 5/1990 Honda et al. ..... 343/702
5,483,246 A * 1/1996 Barnett et al. ..... 343/700 MS
5,977,921 A * 11/1999 Niccolai et al. ..... 343/741
6,384,793 B2 * 5/2002 Scordilis ..... 343/767

(Continued)

FOREIGN PATENT DOCUMENTS

JP 63-046807 2/1988

(Continued)

OTHER PUBLICATIONS

Garg, R., et al., "Circularly Polarized Microstrip Antennas and Techniques", Microstrip Antenna Design Handbook, pp. 493-515.

(Continued)

*Primary Examiner*—Huedung Mancuso
(74) *Attorney, Agent, or Firm*—McDermott Will & Emery LLP

(57) ABSTRACT

A polarization switching/variable directivity antenna according to the present invention includes a ground conductor plate 12 on a surface of a dielectric substrate 11, and has a radiation element 13, a directivity switching element 15, and polarization switching elements 16 provided on the ground conductor plate 12 side of the dielectric substrate 11. The radiation element 13 includes a first slot 17*a* formed by removing a loop-like portion from the ground conductor plate 12. The directivity switching element 15 includes a second slot 17*b* formed by removing a loop-like portion from the ground conductor plate 12 and directivity switching switches 18. The polarization switching elements 16 includes a third slot 17*c* formed by removing a linear-shaped portion from the ground conductor plate 12 and polarization switching switches 19*a* to 19*d*. Through control of the directivity switching switches 18, switching of a maximum gain direction of radiation directivity of the antenna is realized. Through control of the polarization switching switches 19*a* to 19*d*, switching of a rotation direction of a circularly polarized wave which is emitted from the antenna can be realized.

3 Claims, 16 Drawing Sheets

U.S. PATENT DOCUMENTS

| | | | | |
|---|---|---|---|---|
| 6,573,874 | B1 | 6/2003 | Saito et al. | |
| 6,693,598 | B1 * | 2/2004 | Bishop et al. | 343/741 |
| 6,906,677 | B2 * | 6/2005 | Yamamoto et al. | 343/789 |
| 7,109,928 | B1 * | 9/2006 | Thiele et al. | 343/700 MS |
| 2003/0201941 | A1 | 10/2003 | Aikawa et al. | |
| 2005/0200530 | A1 | 9/2005 | Aikawa et al. | |

FOREIGN PATENT DOCUMENTS

| | | |
|---|---|---|
| JP | 7-7321 | 1/1995 |
| JP | 9-307350 | 11/1997 |
| JP | 11-355030 | 12/1999 |
| JP | 2000-223927 | 8/2000 |
| JP | 2004-266333 | 9/2004 |
| JP | 2005-072915 | 3/2005 |
| JP | 2005-286854 | 10/2005 |
| JP | 2006-014272 | 1/2006 |
| JP | 2006-157129 | 6/2006 |
| JP | 2006-157583 | 6/2006 |
| JP | 2006-196974 | 7/2006 |
| JP | 2006-310927 | 11/2006 |
| WO | WO 2006/059568 A1 | 6/2006 |

OTHER PUBLICATIONS

Japanese Decision to Grant a Patent issued in Japanese Patent Application No. JP 2008-504566 mailed on Nov. 18, 2008.

International Search Report issued in International Patent Application No. PCT/JP2007/069756, dated Jan. 8, 2008.

* cited by examiner

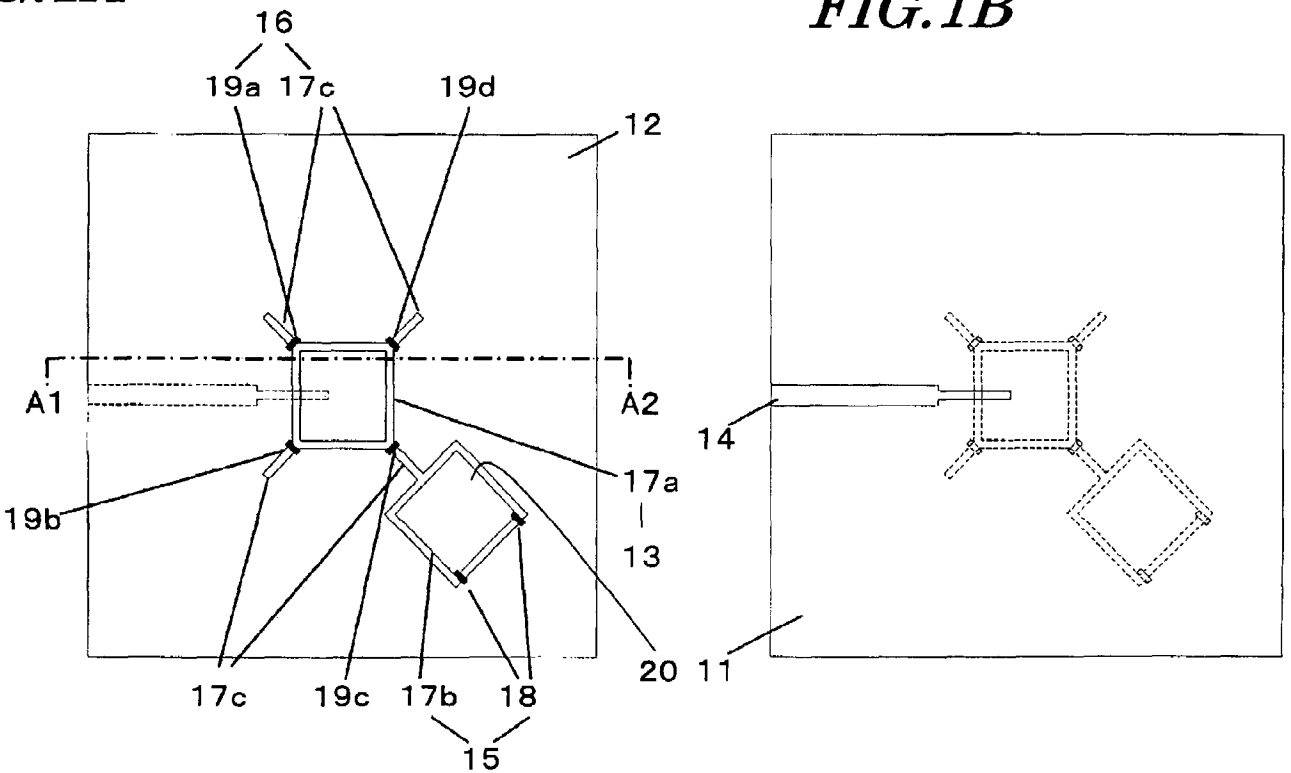
FIG. 1A
FIG. 1B
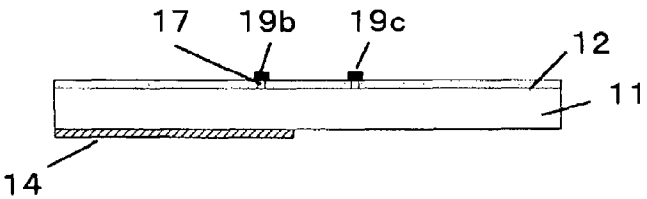
FIG. 1C

Linearly Polarized Waves

Counterclockwise Circularly Polarized Waves

Clockwise Circularly Polarized Waves

POLARIZATION SWITCHING/VARIABLE DIRECTIVITY ANTENNA

This is a continuation of International Application No. PCT/JP2007/069756, with an international filing date of Oct. 10, 2007, which claims priority of Japanese Patent Application No. 2006-304733, filed on Nov. 10, 2006, the contents of which are hereby incorporated by reference.

BACKGROUND OF THE INVENTION

1. Field of the Invention

The present invention relates to an antenna which is suitable for high-quality wireless communications in the microwave and extremely high frequency ranges, where communications are performed while switching the rotation direction of a circularly polarized wave and a maximum gain direction of radiation directivity.

2. Description of the Related Art

In recent years, there are increasing needs for rapid large-capacity communications in a closed space, e.g., an indoor space, as exemplified by indoor wireless LAN, for example. In a closed space such as an indoor space, there are not only direct waves along a line-of-sight between antennas, but also delayed waves due to reflections from the walls, ceiling, or the like exist, thus constituting an environment of multipath propagation. This multipath propagation is a cause for deterioration of the communication quality.

In order to suppress deteriorations in communication quality that are caused by delayed waves in a multipath propagation environment, one method employs an antenna which permits switching of a maximum gain direction of radiation directivity. This is a method that enhances the communication quality by switching the maximum gain direction of the antenna and performing transmission/reception in a selected optimum state.

There is also a method which employs a circular polarization antenna in order to suppress deteriorations in communication quality caused by delayed waves in a multipath propagation environment. A circularly polarized wave is an electromagnetic wave which advances while the direction of its electric field vector rotates with time. When the direction of advancement is viewed from a fixed place, a circularly polarized wave whose electric field vector rotates clockwise is referred to as a clockwise circularly polarized wave, whereas a circularly polarized wave whose electric field vector rotates counterclockwise is referred to as a counterclockwise circularly polarized wave.

Usually, it is difficult to generate a completely circularly polarized wave, because it will merge with a polarization component of the opposite rotation, thus resulting in an elliptically polarized wave. The ratio between the major axis and the minor axis of this ellipse is referred to as an axial ratio, which serves as an index representing the characteristics of the circularly polarized wave. The smaller the axial ratio is, the better the circular polarization characteristics are. In a usual circular polarization antenna, the value of the axial ratio is 3 dB or less.

An antenna which is designed to transmit or receive clockwise circularly polarized waves cannot transmit or receive counterclockwise circularly polarized waves. Similarly, an antenna which is designed to transmit or receive counterclockwise circularly polarized waves cannot transmit or receive clockwise circularly polarized waves. Generally speaking, a circularly polarized wave which has impinged on an obstacle such as a wall becomes a circularly polarized wave of the opposite rotation, and is reflected therefrom. In other words, through one reflection, a clockwise circularly polarized wave becomes a counterclockwise circularly polarized wave, and through another reflection, again becomes a clockwise circularly polarized wave. Therefore, by using a circularly polarized wave for indoor communications, multipath components ascribable to a single reflection can be suppressed.

As a planar antenna which is capable of transmitting and receiving circularly polarized waves, a planar antenna that is described in Ramash Garg et al., "Microstrip Antenna Design Handbook", Artech House, p. 493-515 (Hereinafter, Non-Patent Document 1) is well known, for example. FIG. 15A is a schematic illustration showing a generic linear polarization antenna, and FIGS. 15B and 15C are schematic illustrations showing the generic circular polarization antenna structures described in Non-Patent Document 1. In order to generate a circularly polarized wave, it is necessary to employ two linear polarization components which have orthogonal planes of polarization and whose phases are shifted by 90°. In a commonly-employed radiation conductor plate 31 as shown in FIG. 15A, which is shaped so as to be axisymmetrical with respect to a line extending through a center of gravity 32 of the radiation conductor plate and a feed point, resonation occurs only in such a manner that the electric current oscillates in the direction of the aforementioned line, whereby a linearly polarized wave having a plane of polarization in this oscillation direction results.

In order to generate a circularly polarized wave from the aforementioned axisymmetrically-shaped radiation conductor plate 31, the aforementioned resonation must be separated into two orthogonal resonations. In order to separate the aforementioned resonation, the structural symmetry of the radiation conductor plate 31 may be broken as shown in FIGS. 15B and 15C, for example. At this time, depending on where the symmetry is broken, a counterclockwise circularly polarized wave may be excited as shown in FIG. 15B, or a clockwise circularly polarized wave may be excited as shown in FIG. 15C.

However, as an antenna to be internalized in a laptop computer or an antenna for a mobile device, circular polarization antennas such as those shown in FIGS. 15B and 15C are unsuitable. The position and orientation of such a mobile terminal may greatly change, so that a circular polarization antenna having a fixed rotation direction may not be able to perform transmission/reception when it is reversed in orientation, for example. Therefore, as an antenna for realizing high-quality and high-efficiency communications in a mobile terminal device, there is needed an antenna that permits control of the rotation direction of a circularly polarized wave.

Moreover, communications with an even higher quality and higher efficiency can be realized by simultaneously realizing the aforementioned two functions that are effective for elimination of multipaths, i.e., a "function of switching the maximum gain direction of radiation directivity" and a "function of switching the rotation direction of a circularly polarized wave".

One conventional antenna that simultaneously realizes the aforementioned two functions, i.e., "switching of the rotation direction of a circularly polarized wave" and "switching of a maximum gain direction of radiation directivity" is a phased array antenna whose array elements are antennas capable of switching circular polarization (see Japanese Laid-Open Patent Publication No. 2000-223927 (Hereinafter, Patent Document 1)). FIG. 16A is a block diagram showing the construction of one unit of a conventional circular polarization switching type-phased array antenna described in Patent Document 1, supra. FIG. 16B is a block diagram showing the overall construction of a circular polarization switching type-phased array antenna.

As shown in FIG. 16A, in each antenna unit of a conventional circular polarization switching type-phased array antenna, switching of the rotation direction of a circularly polarized wave is realized through control of external signals s41 and s42, and switching of the radiation phase of the antenna is realized through control of external signals s43, s44 and s45. By building a multi-element construction composed of such units, as shown in FIG. 16B, and controlling all external signals by using an external controller, switching of the rotation direction of a circularly polarized wave and a maximum gain direction of radiation directivity of the entire phased array antenna is simultaneously realized.

[Patent Document 1] Japanese Laid-Open Patent Publication No. 2000-223927

[Patent Document 2] Japanese Laid-Open Patent Publication No. 9-307350

[Non-Patent Document 1] Ramash Garg et al., "Microstrip Antenna Design Handbook", Artech House, p. 493-515

However, an antenna having the above-described conventional construction is unsuitable as an antenna for a small-sized device or terminal because of problems such as: a plurality of phase shifters being required, thus resulting in complicated construction and control, and switching of a plurality of feed lines being required, thus resulting in a large insertion loss associated with switching elements.

SUMMARY OF THE INVENTION

The present invention solves the aforementioned conventional problems, and an objective thereof is to provide an antenna having a construction in which no phase shifter is used and there is only a single feed line so that there is no need for switching, thus simultaneously realizing switching of a maximum gain direction of radiation directivity of the antenna and switching of the rotation direction of a circularly polarized wave, with good axial ratio characteristics in the maximum gain direction.

The present invention, which solves the aforementioned problems, is directed to a polarization switching/variable directivity antenna, including:

a dielectric substrate 11;

a ground conductor plate 12 formed on a surface of the dielectric substrate 11;

at least one radiation element 13 provided within bounds of the ground conductor plate;

a feed member 14 for the radiation element;

at least one directivity switching element 15 provided on the ground conductor plate side of the dielectric substrate 11; and at least two polarization switching elements 16 provided on the ground conductor plate side of the dielectric substrate 11, wherein, the at least one radiation element 13 includes a first slot 17*a* which is formed by removing a loop-like portion from the ground conductor plate, the first slot 17*a* has a peripheral length which corresponds to one effective wavelength at an operating frequency, and the at least one radiation element 13 is shaped so as to be axisymmetrical with respect to a line extending through a center of gravity 21 of an internal conductor surrounded by the first slot 17*a* and through a feed point 22, the feed point 22 being a point where the feed member 14 is in contact with the radiation element 13;

the at least one directivity switching element 15 includes a second slot 17*b* which is formed by removing a loop-like portion from the ground conductor plate, and at least two directivity switching switches 18 each of which is connected so as to bridge between an internal conductor 20 surrounded by the second slot 17*b* and the ground conductor plate surrounding the second slot;

the second slot 17*b* resonates at a frequency which is substantially equal to a resonant frequency of the first slot 17*a;* the second slot 17*b* has a peripheral length which corresponds to one effective wavelength at the operating frequency;

the directivity switching switches 18 are positioned so that, when the second slot is split into a plurality of slots in high-frequency terms by allowing all of the at least two directivity switching switches 18 to conduct, the length of each slot having been split at both ends which are the at least two directivity switching switches 18 is less than half the effective wavelength, or is greater than half the effective wavelength and yet less than one effective wavelength;

the at least two polarization switching elements 16 each include a third slot 17*c* which is formed by removing a linear-shaped portion from the ground conductor plate surrounding the first slot 17*a* so as to be continuous with the first slot, and at least one polarization switching switch 19*a* to 19*d* which is connected so as to bridge across the third slot 17*c*, between portions of the ground conductor plate surrounding the third slot 17*c;* the circular polarization index Q0($\Delta s/s$) has a value of no less than 2.2 and no more than 4.0, where $\Delta s$ is a total area of the third slot or third slots 17*c* coupling to the first slot 17*a* when a corresponding polarization switching switch or polarization switching switches 19*a* to 19*d* are opened; s is an area of a slot portion of the first slot; and Q0 is an unloaded Q of the first slot;

with respect to an angle $\xi$ between a line extending through the center of gravity of the internal conductor surrounded by the first slot and through the feed point and a line extending through the center of gravity of the internal conductor surrounded by the first slot and through a branch point at which each third slot branches out from the first slot, one third slot of the at least two polarization switching elements is provided so as to satisfy either a range of $0° < \xi < 90°$ or a range of $180° < \xi < 270°$, and another third slot of the at least two polarization switching elements is provided so as to satisfy either a range of $90° < \xi < 180°$ or a range of $270° < \xi 360°$; and the second slot is continuous with the first slot via a third slot.

Based on the above construction, it is possible to simultaneously achieve switching of the maximum gain direction and switching of the rotation direction of a circularly polarized wave in the maximum gain direction.

Further preferably, the circular polarization index Q0 is no less than 2.7 and no more than 3.2. Under this condition, further better circularly polarized wave characteristics can be obtained.

Every third slot defining the at least two polarization switching elements may be continuous with a second slot of the at least one directivity switching element. With this construction, the maximum gain direction of radiation directivity can be changed into a plurality of directions.

A polarization switching/variable directivity antenna of the present invention realizes, in a simple construction which uses no phase shifters, switching of a maximum gain direction of radiation directivity and switching of the rotation direction of a circularly polarized wave which has good axial ratio characteristics along the maximum gain direction.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIGS. 1A to 1C are schematic illustrations of a polarization switching/variable directivity antenna according to Embodiment 1 of the present invention. FIG. 1A is a see-through view of a first substrate surface; FIG. 1B is a see-through view of a second substrate surface; and FIG. 1C is a cross-sectional view of the substrate taken along A1-A2.

DETAILED DESCRIPTION OF PREFERRED EMBODIMENTS

Hereinafter, embodiments of the present invention will be described with reference to the accompanying drawings.

Embodiment 1

First, FIGS. 1A to 1C, which illustrate Embodiment 1 of the present invention, will be referred to FIG. 1A is a see-through view of a first surface (hereinafter, "front face") of a dielectric substrate 11. FIG. 1B is a see-through view of a second surface (hereinafter, "rear face") of the dielectric substrate 11 which opposes the first surface. FIG. 1C is a cross-sectional view taken along line A1-A2 in FIG. 1A.

As shown in FIG. 1, the antenna of the present embodiment includes a ground conductor plate 12 on the front face of the dielectric substrate 11. A loop-shaped first slot 17*a*, a loop-shaped second slot 17*b*, and linear-shaped third slots 17*c* are provided in the ground conductor plate 12. The slot 17*b* has at least two directivity switching switches 18 provided thereon, and each slot 17*c* has at least one polarization switching switch (19*a* to 19*d*) provided thereon. A feed member 14 is provided on the rear face of the dielectric substrate 11. Switching of the maximum gain direction is realized through control of the directivity switching switches 18, and switching of the rotation direction of a circularly polarized wave is realized through control of the polarization switching switches 19*a* to 19*d*.

The construction according to the present embodiment is a simple construction which employs no phase shifters, and can be operated with a single feed line. Therefore, any insertion loss associated with switching elements, which might otherwise be required for switching a plurality of feed lines, can be avoided.

Figure 2:
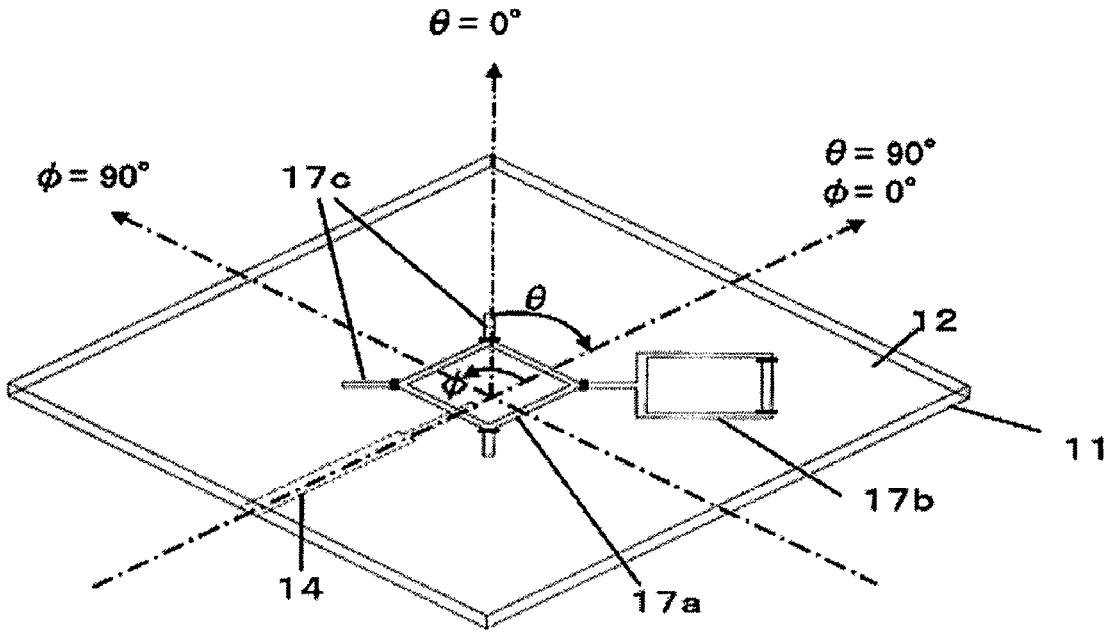
FIG. 2 is a perspective view of a polarization switching/variable directivity antenna according to Embodiment 1 of the present invention.

FIG. 2 shows a perspective view of the first substrate surface of the antenna according to Embodiment 1 of the present invention. In the antenna of Embodiment 1, a $\phi$ axis and a $\theta$ axis are defined as shown in FIG. 2. Hereinafter, in the present specification, radiation directivity will be illustrated according to this coordinate system.

Now, the principles behind switching of circular polarization and switching of the maximum gain direction of radiation directivity according to the polarization switching/variable directivity antenna of Embodiment 1 of the present invention will be specifically described.

(Circular Polarization Switching)

First, the principle behind switching of circular polarization will be described. Switching of circular polarization is performed with polarization switching elements 16. Now, the polarization switching elements 16 will be described. At least two polarization switching elements 16 are provided within bounds of the ground conductor plate 12, each being composed of a linear-shaped third slot 17*c* and a polarization switching switch (19*a* to 19*d*). The third slots 17*c* are formed so as to branch out from the loop-shaped first slot 17*a*, and, by controlling the polarization switching switches 19*a* to 19*d* so as to be conducting or open, symmetry of the first slot 17*a* composing the radiation element 13 is broken, whereby resonation is separated.

Figure 3:
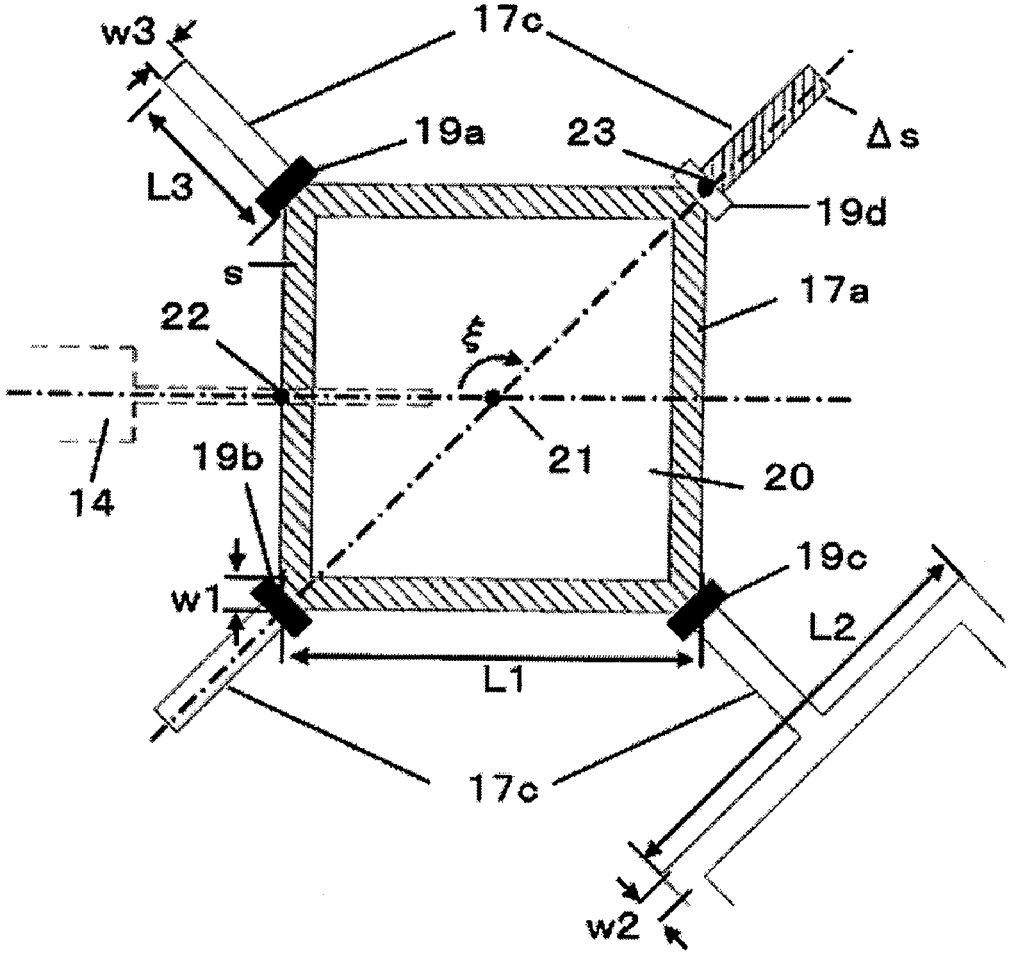
FIG. 3 is an enlarged view of a radiation element and polarization switching elements of a polarization switching/variable directivity antenna according to Embodiment 1 of the present invention.

FIG. 3 shows an enlarged view of the radiation element 13 and the polarization switching elements 16 according to Embodiment 1 of the present invention. The third slots 17*c* are formed by removing linear-shaped portions from the ground conductor plate 12 so as to be continuous with the loop-shaped first slot 17*a* (i.e., a obliquely-hatched portion in FIG. 3). In a see-through plan view, an ξ is defined between a line which extends through a center of gravity 21 of the internal conductor surrounded by the first slot 17*a* and through a feed point 22 (i.e. a point at which the feed member 14 comes in contact with the radiation element 13) and a line which extends through the center of gravity 21 of the internal conductor and through a branch point 23 at which a given third slot 17*c* branches out from the first slot 17*a*. Among the at least two polarization switching elements 16, one third slot 17*c* is provided so as to satisfy either a range of 0°<ξ<90° or a range of 180°<ξ<270°. Another third slot among the at least two polarization switching elements 16 is provided so as satisfy either a range of 90°<ξ<180° or a range of 270°<ξ360°.

If the third slots 17*c* were provided at positions satisfying ξ=0°, 90°, 180°, or 270°, symmetry of the radiation element 13 would not be broken, and the effect of generating a circularly polarized wave would not be obtained. Therefore, the third slots 17*c* must be provided in positions other than ξ=0°, 90°, 180°, or 270°. Note that a preferable set of values of ξ is 45°, 135°, 225°, and 315°.

Moreover, if all third slots 17*c* among the at least two polarization switching elements 16 were provided only in the two opposing ranges satisfying 0°<ξ<90° or 180°<ξ<270°, the rotation directions would be identical, so that no polarization switching effect would be obtained even if the polarization switching switches 19 were switched. Therefore, in order to obtain a polarization switching function, it is necessary that one third slot 17*c* among the at least two polarization switching elements 16 is provided so as to satisfy either a range of 0°<ξ<90° or a range of 180°<ξ<270°, and that another third slot 17*c* among the at least two polarization switching elements 16 is provided so as to satisfy either a range of 90°<ξ<180° or a range of 270°<ξ360°.

Furthermore, if the first slot 17*a* composing the radiation element 13 were not axisymmetrical with respect to the line extending through the center of gravity 21 of the internal conductor surrounded by the first slot 17*a* and through the feed point 22, symmetry of the radiation element 13 would already be broken, without even providing the polarization switching elements 16. In this case, a circularly polarized wave (elliptically polarized wave) would already exist in either rotation direction, thus making it difficult to switch the rotation direction by providing the polarization switching elements 16. Therefore, it is necessary that the first slot 17*a* is axisymmetrical with respect to the line extending through the center of gravity 21 of the internal conductor and through the feed point 22.

Each polarization switching switch (19*a* to 19*d*) is connected so as to bridge across the third slot 17*c*, between portions of the ground conductor plate 12 surrounding the third slot 17*c*. By controlling at least one of the polarization switching switches 19*a* to 19*d* to be open, a circularly polarized wave can be generated. By selecting the positions of the polarization switching switches 19*a* to 19*d* to be open, switching of the rotation direction of a circularly polarized wave can be realized. Table 1 shows, when the polarization switching switches 19*a* to 19*d* in the antenna of FIG. 1 are switched, rotation directions of the circularly polarized wave that are obtained in the respective operating states according to Embodiment 1.

TABLE 1

| | polarization switching switch | | | | rotation direction of circularly |
|---|---|---|---|---|---|
| | 19a | 19b | 19c | 19d | polarized wave |
| 1 | open | conducting | conducting | conducting | clockwise |
| 2 | conducting | open | conducting | conducting | counterclockwise |
| 3 | conducting | conducting | open | conducting | clockwise |
| 4 | conducting | conducting | conducting | open | counterclockwise |

As shown in Table 1, by allowing a selected one of the polarization switching switches 19*a* to 19*d* to conduct, the rotation direction of the circularly polarized wave can be switched. Similarly, among the polarization switching switches 19*a* to 19*d*, either pair of diagonal switches (19*a* and 19*c*, or 19*b* and 19*d*) may be selectively allowed to conduct, whereby the rotation direction of the circularly polarized wave can be switched. Furthermore, three of the polarization switching switches 19*a* to 19*d* may be selectively allowed to conduct, whereby the rotation direction of the circularly polarized wave can be switched.

Note that, when only two adjoining switches (e.g. 19*a* and 19*b*) are allowed to conduct, and when all of the polarization switching switches are allowed to conduct or left open, a linearly polarized wave can be obtained from the antenna.

In the antenna of Embodiment 1, a circularly polarized wave is generated by the third slots 17*c* provided within bounds of the ground conductor plate 12. Assuming a perturbation quantity Δs/s which is determined by two parameters, i.e., an area s of the slot portion of the first slot 17*a* (i.e., the obliquely-hatched portion in FIG. 3) and an area Δs of a third slot 17*c* which couples to the first slot 17*a* when a corresponding polarization switching switch (19*a* to 19*d*) is opened (i.e., the vertically-hatched portion in FIG. 3), and assuming Q0 as an unloaded Q of the radiation element 13, the circularly-polarized-wave axial ratio of the radiation element 13 depends on a circular polarization index Q0(Δs/s), which is defined by a product of the perturbation quantity and the unloaded Q.

Q0 is a value which is determined by the dielectric constant of the dielectric substrate 11, the width of the first slot 17*a* of the radiation element 13, and the like. By selecting the length and width of each third slot 17*c* so that an optimum value of Δs is obtained for a given Q0, a circular polarization antenna having a good axial ratio can be realized.

Table 2 is a table showing, with respect to the antenna of Embodiment 1, values of the circularly-polarized-wave axial ratio relative to the circular polarization index, where the Q0 of the radiation element 13 is varied among 4.58, 5.55, and 7.62.

TABLE 2

| | | | | | | | | | | | | |
|---|---|---|---|---|---|---|---|---|---|---|---|---|
| | Q0 = 4.58 | | | | | | | | | | | |
| | circular polarization index | | | | | | | | | | | |
| | 2.07 | 2.30 | 2.52 | 2.74 | 2.96 | 3.18 | 3.41 | 3.63 | 3.85 | 4.07 | 4.29 | 4.52 |
| Axial ratio [dB] | 3.06 | 2.20 | 1.39 | 0.68 | 0.34 | 0.78 | 1.33 | 1.87 | 2.38 | 2.87 | 3.33 | 3.75 |
| | Q0 = 5.55 | | | | | | | | | | | |
| | circular polarization index | | | | | | | | | | | |
| | 1.22 | 1.54 | 1.86 | 2.17 | 2.49 | 2.81 | 3.13 | 3.44 | 3.76 | 4.08 | 4.40 | 4.71 |
| axial ratio [dB] | 5.92 | 4.39 | 3.19 | 2.00 | 1.09 | 0.51 | 1.05 | 1.71 | 2.43 | 3.07 | 3.73 | 4.29 |
| | Q0 = 7.62 | | | | | | | | | | | |
| | circular polarization index | | | | | | | | | | | |
| | 1.91 | 2.09 | 2.26 | 2.44 | 2.61 | 2.79 | 2.97 | 3.14 | 3.32 | 3.50 | 3.67 | 3.85 |
| axial ratio [dB] | 3.85 | 3.01 | 2.29 | 1.58 | 0.92 | 0.34 | 0.22 | 0.73 | 1.22 | 1.68 | 2.11 | 2.51 |

Figure 4:
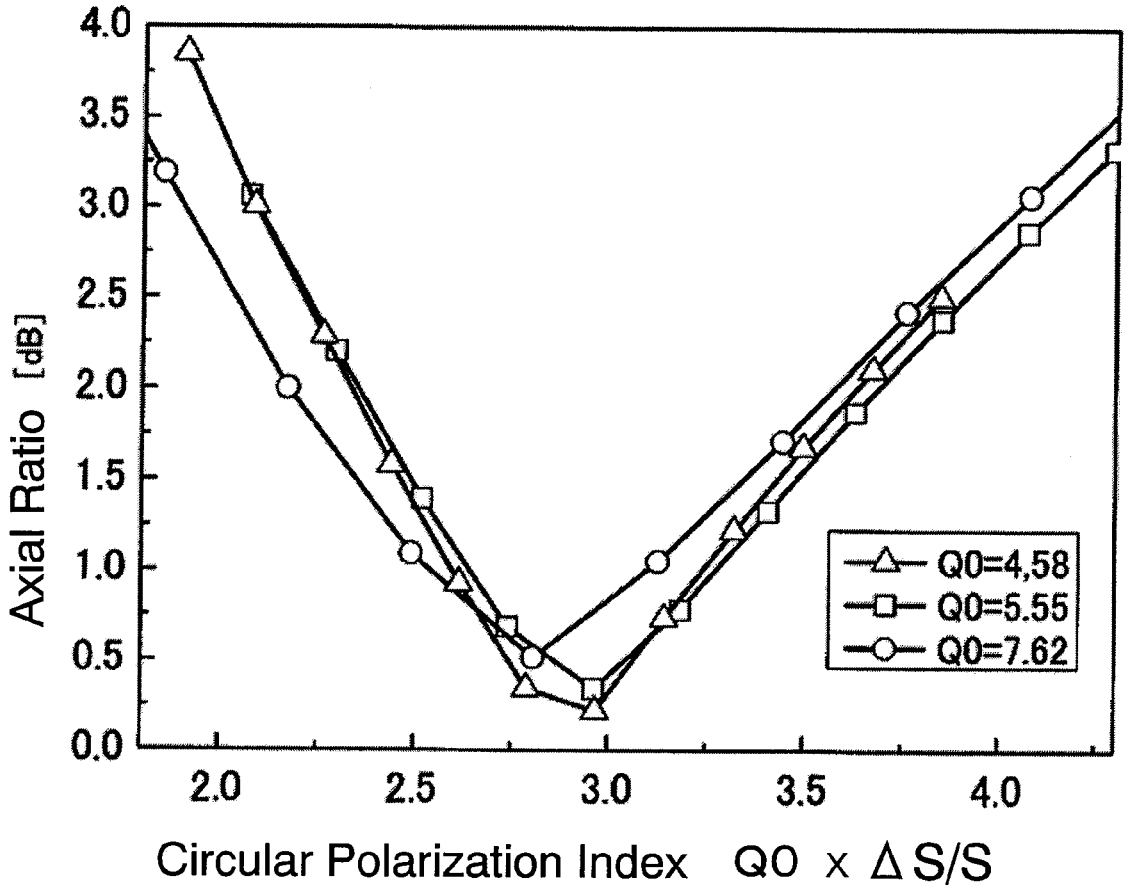
FIG. 4 is a graph showing an axial ratio dependence of a circular polarization index of a polarization switching/variable directivity antenna according to Embodiment 1 of the present invention.

In Table 2, the dielectric substrate 11 has a constant dielectric constant, while the width of the first slot 17*a* of the radiation element 13 is varied so that Q0 of the radiation element 13 is varied among 4.58, 5.55, and 7.62. FIG. 4 presents a graph according to Table 2, showing values of the circularly-polarized-wave axial ratio relative to the circular polarization index, where the Q0 of the radiation element 13 is varied among 4.58, 5.55, and 7.62. In FIG. 4, the horizontal axis represents the circular polarization index value, whereas the vertical axis represents the circularly-polarized-wave axial ratio of the antenna of Embodiment 1. As can be seen from Table 2 and FIG. 4, with the antenna of Embodiment 1, an axial ratio of 3 dB or less can be achieved under any of these three conditions by designing the antenna so that the circular polarization index is in a range of no less than 2.2 and no more than 4.0. By designing the antenna so that the circular polarization index is in a range of no less than 2.7 and no more than 3.2, the axial ratio is reduced to 1 dB or less, whereby a circularly polarized wave with even better axial ratio characteristics can be obtained.

Note that, even if the area Δs differs among the third slots 17*c* of the at least two polarization switching elements, there is no problem in use so long as each Δs value satisfies the aforementioned range.

(Switching of a Maximum Gain Direction of Radiation Directivity)

Next, the principle behind switching of the maximum gain direction in accordance with the antenna of Embodiment 1 will be described. Switching of the maximum gain direction is performed with a directivity switching element 15, which is composed of the loop-shaped second slot 17*b* and the directivity switching switches 18.

The second slot 17*b* resonates at a frequency which is substantially equal to the resonant frequency of the first slot 17*a* of the radiation element 13, and the peripheral length thereof corresponds to one effective wavelength. At this time, the second slot 17*b* functions as an antenna element to which no power is fed (hereinafter "unfed element"). Generally, an unfed element is known to act as a director when the resonant frequency of the unfed element is higher than the resonant frequency of an antenna element to which power is fed (hereinafter "fed element"), so that the directivity gain of the entire antenna is inclined in the direction in which the unfed element exists. On the other hand, when the resonant frequency of the unfed element is lower than the resonant frequency of the fed element, the unfed element is known to act as a reflector, so that the directivity gain of the entire antenna is inclined in the opposite direction to the direction in which the unfed element exists. In Embodiment 1, the second slot 17*b*, which is an unfed element, is disposed next to the first slot 17*a*, which is a fed element. Thus, the maximum gain direction of the antenna is allowed to be changed.

At least two directivity switching switches 18 are provided, each directivity switching switch 18 being connected so as to bridge across the second slot 17*b*, between an internal conductor 20 which is surrounded by the second slot 17*b* and the ground conductor plate 12 surrounding the second slot 17*b*. When each directivity switching switch 18 is open, the second slot 17*b* functions as a director or a reflector as described above. On the other hand, when the directivity switching switch 18 is allowed to conduct, the second slot 17*b* is split into two or more slots, whereby the aforementioned director or reflector function disappears. Therefore, by controlling the conducting/open states of the directivity switching switches 18, a function of switching the maximum gain direction can be realized.

Note, however, that the directivity switching switches 18 must be positioned so that the second slot 17*b* does not resonate with the first slot 17*a* when the directivity switching switches 18 are conducting. If each slot that has been split at both ends (i.e., the directivity switching switches 18) acted as a resonator when the directivity switching switches 18 are allowed to conduct, such slot resonators would exhibit similar effects to those of the aforementioned director or reflector. In this case, the director or reflector effects would not be eliminated even when the second slot 17*b* is split by the conducting directivity switching switches 18. For example, if the length of each slot that has been split at both ends (i.e., the directivity switching switches 18) when the directivity switching switches 18 are allowed to conduct were equal to half the effective wavelength, even though the slot may be split, each split slot would act as a resonator with half the effective wavelength, and therefore a directivity switching effect would not be switched through control of the directivity switching switches 18.

Therefore, the directivity switching switches 18 must be positioned so that, when the directivity switching switches 18 are conducting, the length of each part of the second slot 17*b* that has been split at both ends (i.e., the two adjoining directivity switching switches 18) is less than half the effective wavelength, or is greater than half the effective wavelength and yet less than one effective wavelength. As a result, it becomes possible to eliminate the unwanted resonation effect of each slot that has been split at both ends (i.e., the directivity switching switches 18) when the directivity switching switches 18 are conducting.

Usually, on a radiation element 13 which is capable of transmitting or receiving circularly polarized waves, too, it is possible to change the maximum gain direction of the antenna regardless of the shape and size of the unfed element, so long as it resonates with the radiation element 13. However, it is difficult to obtain good axial ratio characteristics in the changed maximum gain direction. This is because the electromagnetic waves which are emitted from the unfed element deteriorate the axial ratio characteristics of the circularly polarized waves which are emitted from the radiation element 13.

According to Embodiment 1, a loop-shaped slot (second slot 17*b*) whose length is equal to one effective wavelength is used as an unfed element. By using a loop-shaped slot whose length is equal to one effective wavelength as an unfed element, it becomes possible to excite a circularly polarized wave also on this slot, which is an unfed element.

Figure 5A:
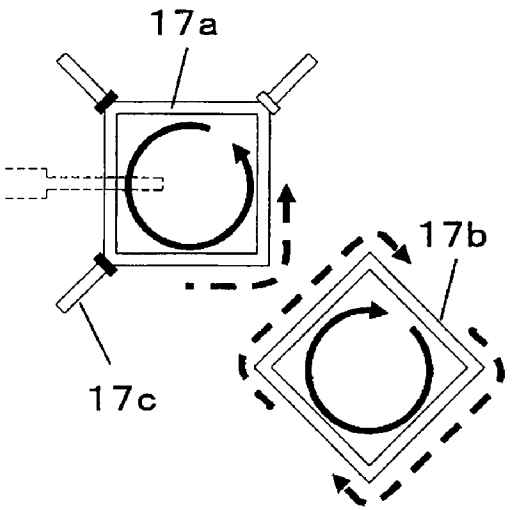
FIGS. 5A to 5C are diagrams showing excitation of a circularly polarized wave to an unfed element, in a polarization switching/variable directivity antenna according to Example 1 of the present invention.
Figure 5B:
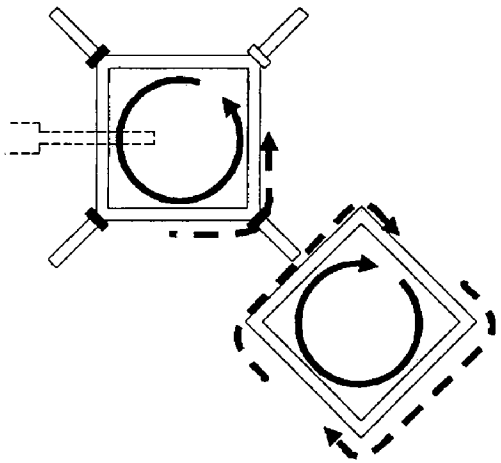

Note that, as shown in FIG. 5A or 5B, if the second slot 17*b* (which is an unfed element) were not continuous with the third slot 17*c* of any polarization switching element, electric currents as shown by the dotted lines in each figure would flow in regions of the ground conductor plate 12 surrounding the first slot and the second slot when a circularly polarized wave is excited in the first slot 17*a* (which is a fed element). Due to these electric currents, a circularly polarized wave whose rotation direction is opposite from the first slot would be excited in the second slot. In this state, the circularly-polarized-wave axial ratio characteristics of the entire antenna would be deteriorated.

Figure 5C:
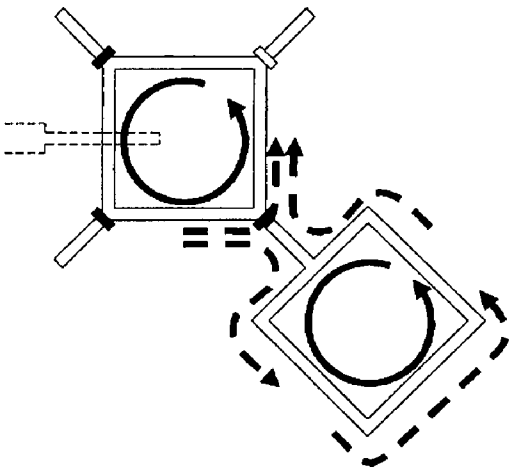

In contrast, according to Embodiment 1, the second slot 17*b* is always continuous with the third slot 17*c*, as shown in FIG. 5C. In this construction, electric currents will flow in the regions of the ground conductor plate surrounding the first and second slots as shown by the dotted lines in FIG. 5C, and a circularly polarized wave having the same rotation direction as in the first slot 17*a* can be excited on the second slot 17*b*. Thus, since circularly polarized waves having the same rotation direction are excited on both of the first slot 17*a* (which is a fed element) and the second slot 17*b* (which is an unfed element), it becomes possible to switch the maximum gain direction while maintaining a good axial ratio.

Moreover, when the rotation direction of the circularly polarized wave that is excited on the first slot 17*a* is switched, the rotation direction of the circularly polarized wave which is excited on the second slot 17*b* is also switched simultaneously. Thus, since the rotation directions associated with the fed element and the unfed element are simultaneously switched, switching of the rotation direction of a circularly polarized wave becomes possible while maintaining a good axial ratio characteristics in the maximum gain direction.

In Embodiment 1, each of the first slot 17*a* of the radiation element 13 and the second slot 17*b* of the directivity switching element 15 is a loop-shaped slot whose peripheral length corresponds to one effective wavelength. Usually, a loop-shaped slot resonates in such a manner that its peripheral length corresponds to N effective wavelengths (where N is an integer). When the peripheral length corresponds to one effective wavelength, the maximum gain direction of radiation directivity can only be oriented in the $\theta=0°$ direction. However, when the peripheral length corresponds to N effective wavelengths except for N=1, the maximum gain direction of radiation directivity may be oriented in a plurality of directions. In the case where the maximum gain direction is oriented in a plurality of directions to begin with, it is difficult to change directivity to a desired direction even with the use of an unfed element. Therefore, according to Embodiment 1, loop-shaped slots whose peripheral length corresponds to one effective wavelength are used as the first slot 17*a* of the radiation element 13 and the second slot 17*b* of the directivity switching element 15.

(Others)

Hereinafter, other constituent elements will be briefly described. As the dielectric substrate 11 according to Embodiment 1, any substrate that is commonly employed in high-frequency circuits can be used. For example, an inorganic material such as alumina ceramic, or a resin-type material such as Teflon (registered trademark), epoxy, or polyimide can be used. Any such material may be appropriately selected depending on the frequency used, the purpose, the thickness and size of the substrate, and so on. The ground conductor plate 12 is a pattern of a metal of good electrical conductivity, and its material may be copper, aluminum, or the like.

In Embodiment 1, there is no particular limitation as to the size of the ground conductor plate 12. However, if an edge of the ground conductor plate 12 lies close to the second slot 17*b* of the directivity switching element 15, electric currents will be less likely to flow in the region of the ground conductor plate surrounding the second slot 17*b*, so that a directivity switching effect may not be fully obtained. In order to prevent this, the distance between the second slot 17*b* and any edge of the ground conductor plate 12 may be kept as wide as the slot width or even wider.

Although the feed member 14 shown in FIG. 1 of Embodiment 1 adopts microstrip feeding, any usual method for feeding power to slots may be adopted, e.g., coaxial feeding.

As the directivity switching switches 18 and the polarization switching switches 19*a* to 19*d* in Embodiment 1, PIN diodes, FETs (Field Effect Transistors), MEMS (Micro Electro-Mechanical System) switches, or the like may be used, which are usually used in high-frequency regions.

Figure 6:
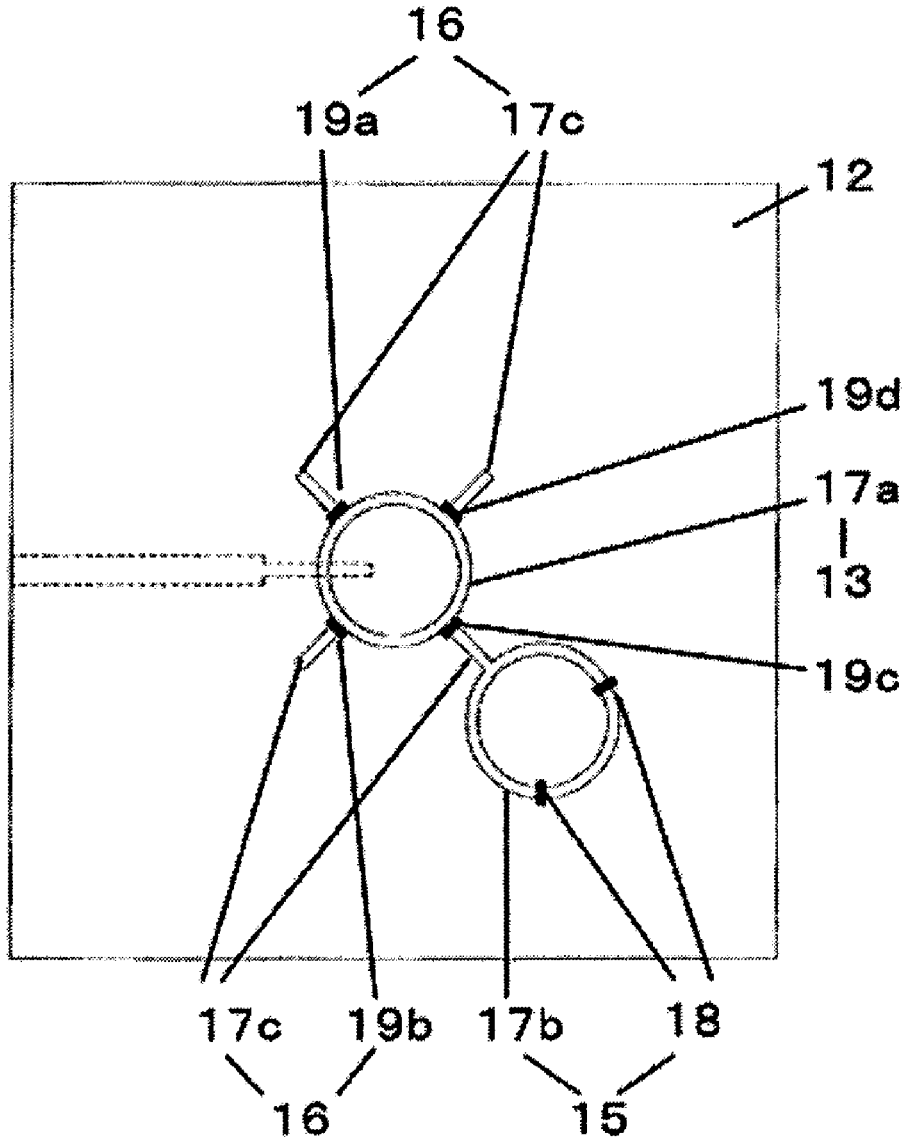
FIG. 6 is a diagram illustrating another example of a polarization switching/variable directivity antenna according to Embodiment 1 of the present invention.

Note that, although Embodiment 1 employs square slots as the first slot 17*a* of the radiation element 13 and as the second slot 17*b*, similar effects can also be obtained with any other kinds of loop-shaped slots, as shown in FIG. 6.

Although Embodiment 1 has illustrated switching of the maximum gain direction into one direction, the number of directivity switching elements may be increased to N (where N is a natural number) according to the number of directions that need to be switched, whereby the maximum gain direction can be switched into N directions.

Example 1

Hereinafter, Example 1 of the present invention will be described. The antenna of Example 1 has the construction shown in FIGS. 1A to 1C, and an enlarged view of the neighborhood of the first slot 17*a* is as shown in FIG. 3. The constituent elements of Example 1 are as shown in Table 3.

TABLE 3

| | |
|---|---|
| dielectric substrate 11 | dielectric constant: 2.08<br>size: 130.0 × 130.0 × 3.2 mm |
| first slot 17a | square<br>length L1 of one side: 25.0 mm<br>slot width w1: 2.0 mm |
| second slot 17b | square<br>length L2 of one side: 22.0 mm<br>slot width w2: 3.0 mm |
| third slot 17c | length L3 of one side: 10.0 mm<br>slot width w3: 4.0 mm |

In this case, the Q0 of the radiation element 13 is calculated to be 5.55, with the circular polarization index being about 3.1. In Example 1, the directivity switching element is allowed to function as a director.

Figure 7A:
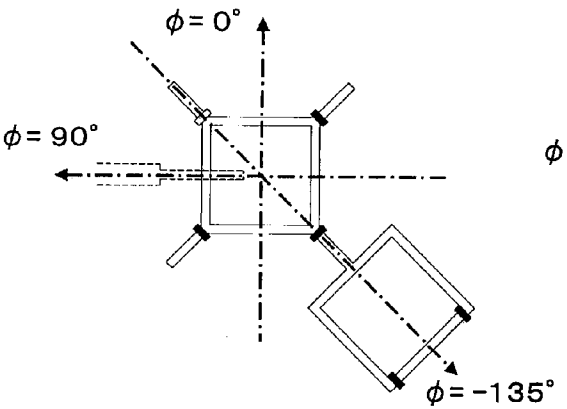
FIGS. 7A to 7C are diagrams showing examples of how switches of a polarization switching/variable directivity antenna according to Example 1 of the present invention may be controlled.
Figure 7B:
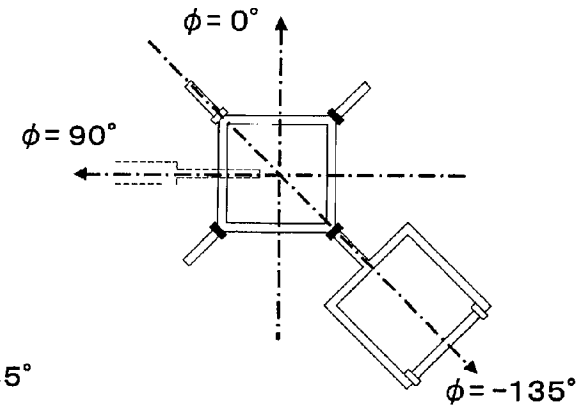
Figure 7C:
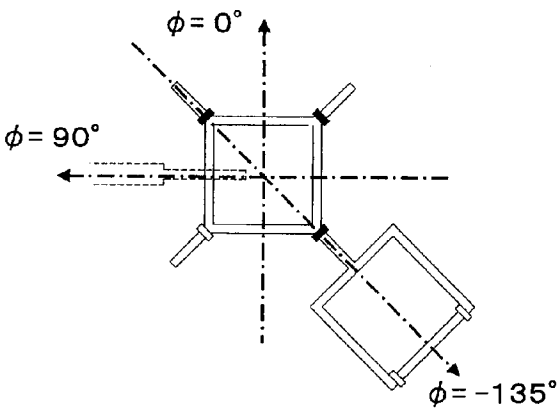

FIGS. 7A, 7B, and 7C are diagrams showing examples of how the directivity switching switches 18 and the polarization switching switches 19*a* to 19*d* may be controlled in order to change the maximum gain direction and the rotation direction of a circularly polarized wave. In FIGS. 7A, 7B, and 7C, it is meant that black switches are in a conducting state, whereas white switches are in an open state. In other words, FIG. 7A shows an example where the directivity switching switches 18 and the polarization switching switches 19*b*, 19*c*, and 19*d* in FIG. 1 are conducting while the polarization switching switch 19*a* is open.

Figure 8A:
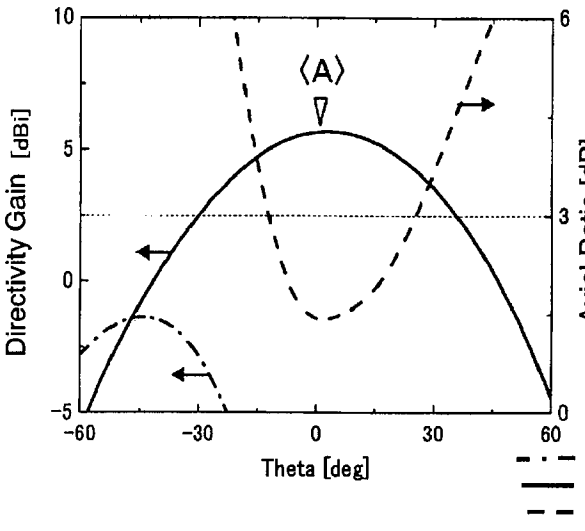
FIGS. 8A to 8C are graphs showing changes in radiation directivity of a polarization switching/variable directivity antenna according to Example 1 of the present invention.
Figure 8B:
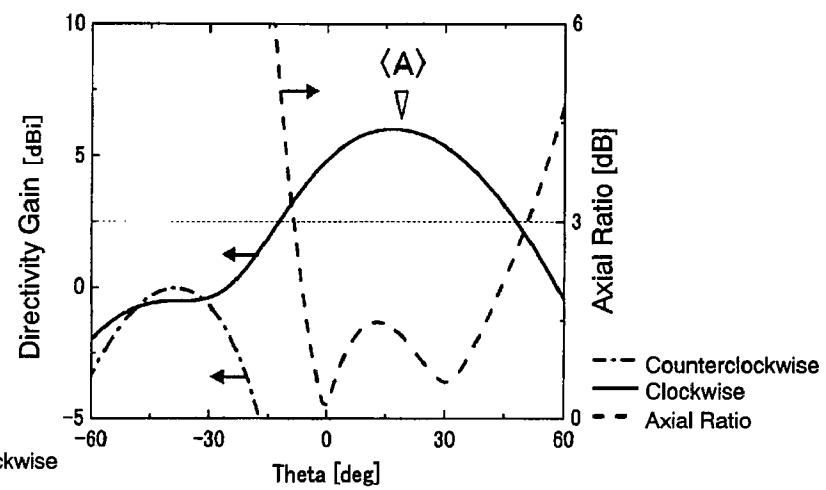
Figure 8C:
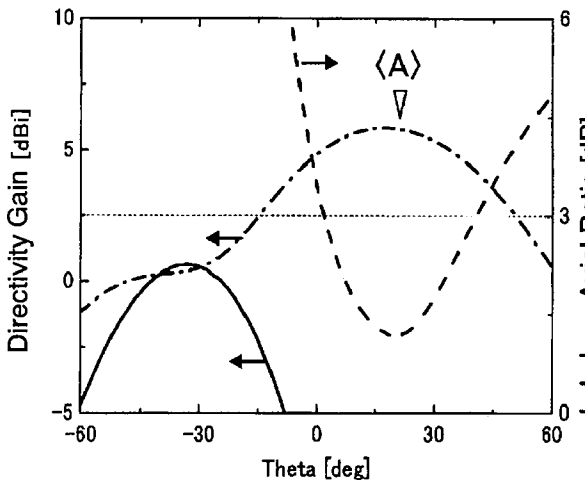

FIGS. 8A, 8B, and 8C show the radiation directivity of the antenna of Example 1 at a frequency of 2.5 GHz, in the case where the directivity switching switches 18 and the polarization switching switches 19*a* to 19*d* are controlled. FIGS. 8A, 8B, and 8C, which respectively correspond to FIGS. 7A, 7B, and 7C, each show a θ dependence of directivity gain on the ϕ=−135° plane. In FIGS. 8A, 8B, and 8C, <A> indicates a maximum gain direction of radiation directivity.

As indicated by <A> in FIGS. 8A and 8B, by controlling the directivity switching switches 18 while the polarization switching switch 19*a* was open and the polarization switching switches 19*b*, 19*c*, and 19*d* were conducting, the maximum gain direction of radiation directivity was switched into the 0° direction (FIG. 8A) or the +20° direction (FIG. 8B) on the ϕ=−135° plane, while maintaining the rotation direction of the circularly polarized wave on the antenna to be clockwise. Moreover, as indicated by <A> in FIGS. 8B and 8C, by controlling the polarization switching switches 19*a* to 19*d* as shown in FIGS. 7B and 7C while fixing the directivity switching switches 18, the rotation direction of the circularly polarized wave was switched to clockwise (FIG. 8B) or counterclockwise (FIG. 8C), while tilting the maximum gain direction to +20°. At this time, under all conditions in FIGS. 8A, 8B, and 8C, an axial ratio of 3 dB or less was achieved in the maximum gain direction.

Figure 9:
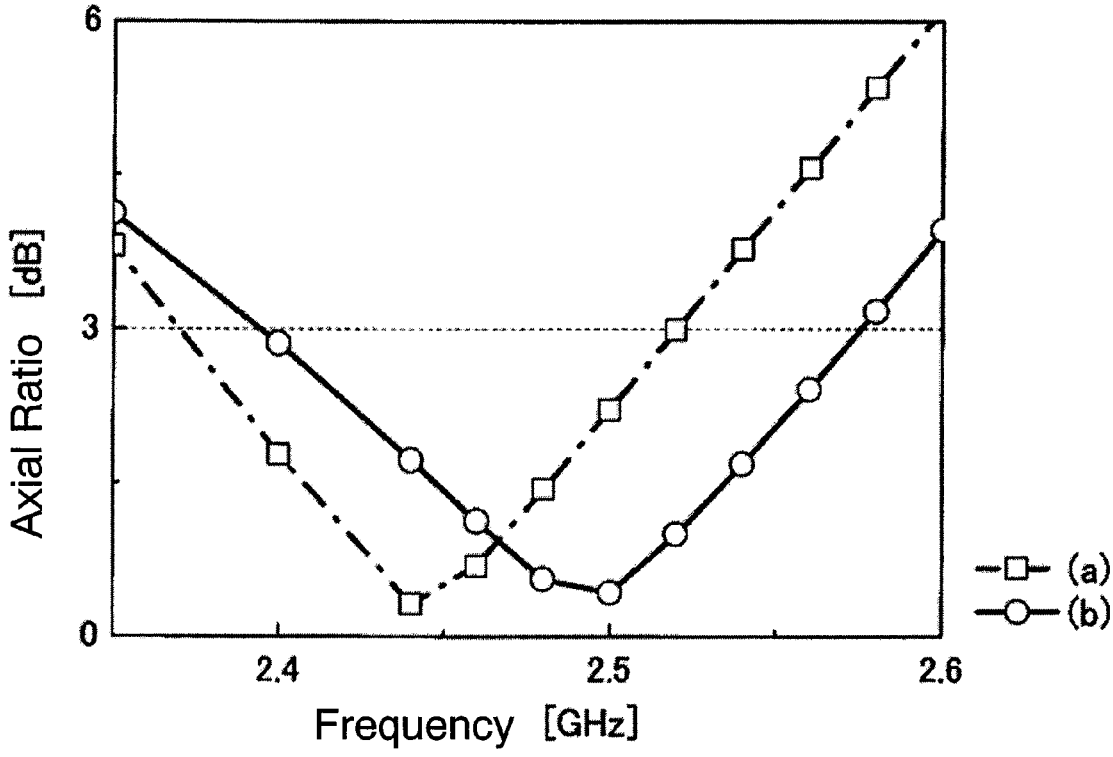
FIG. 9 is a graph showing a frequency dependence of a circularly-polarized-wave axial ratio of a polarization switching/variable directivity antenna according to Example 1 of the present invention.

FIG. 9 shows a frequency dependence of the circularly-polarized-wave axial ratio of the antenna of Example 1 in the maximum gain direction of radiation directivity, when the directivity switching switches 18 are controlled. Table 4 is a tabular representation of FIG. 9, showing a frequency dependence of the circularly-polarized-wave axial ratio in the maximum gain direction of radiation directivity.

TABLE 4

| | frequency [GHz] | | | | | | | | | |
|---|---|---|---|---|---|---|---|---|---|---|
| | 2.35 | 2.40 | 2.44 | 2.46 | 2.48 | 2.50 | 2.52 | 2.54 | 2.56 | 2.58 |
| axial ratio (a) [dB] | 3.80 | 1.78 | 0.32 | 0.69 | 1.44 | 2.21 | 2.99 | 3.78 | 4.56 | 5.35 |
| axial ratio (b) [dB] | 4.12 | 2.86 | 1.72 | 1.12 | 0.56 | 0.43 | 0.99 | 1.68 | 2.40 | 3.17 |

Axial ratio (a) and axial ratio (b) in Table 4, and (a) and (b) in FIG. 9, correspond to the states shown in FIGS. 7A and 7B, respectively. FIG. 9 and Table 4 indicate that, when switching the maximum gain direction of radiation directivity of a circularly polarized wave, an axial ratio of 3 dB or less was achieved across a very wide band, i.e., frequencies of 2.40 to 2.52 GHz and a bandwidth ratio of 4.88%.

Table 5 summarizes the rotation directions of a circularly polarized wave and the maximum gain directions obtained by switching the directivity switching switches 18 and the polarization switching switches 19*a* to 19*d* according to Example 1.

TABLE 5

| | Directivity switching | polarization switching switch | | | | rotation direction of circularly polarized | maximum gain |
|---|---|---|---|---|---|---|---|
| | switch 18 | 19a | 19b | 19c | 19d | wave | direction |
| 1 | con. | open | con. | con. | con. | clockwise | θ = 0° direction |
| 2 | con. | con. | open | con. | con. | counter | θ = 0° direction |

TABLE 5-continued

| | Directivity switching | polarization switching switch | | | | rotation direction of circularly polarized | maximum gain |
|---|---|---|---|---|---|---|---|
| | switch 18 | 19a | 19b | 19c | 19d | wave | direction |
| 3 | open | open | con. | con. | con. | clockwise | θ = 20° direction |
| 4 | open | con. | open | con. | con. | counter | θ = 20° direction |

con. = conducting
counter = counterclockwise

As shown in Table 5, by controlling the directivity switching switches 18 and the polarization switching switches 19*a* to 19*d*, switching of the rotation direction of a circularly polarized wave and switching of the maximum gain direction into multiple directions are simultaneously possible.

Thus, based on the above-described construction, there is realized an antenna which is capable of switching the maximum gain direction, and switching the rotation direction of a circularly polarized wave in the maximum gain direction.

Embodiment 2

Hereinafter, with reference to the drawings, a polarization switching/variable directivity antenna according to Embodiment 2 of the present invention will be described.

Figure 10:
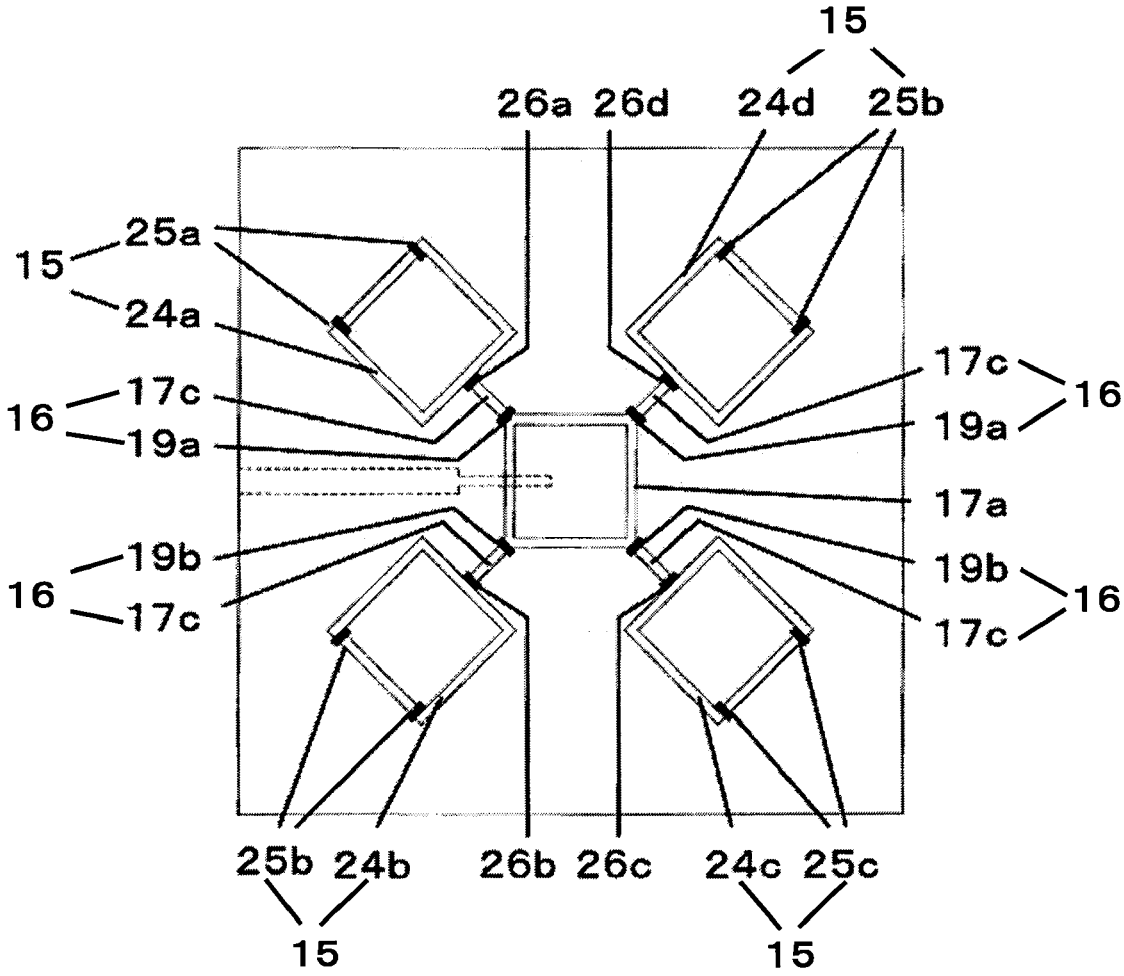
FIG. 10 is a schematic illustration of a polarization switching/variable directivity antenna according to Embodiment 2 of the present invention.

FIG. 10 is a see-through view of a first substrate surface (front face) according to Embodiment 2 of the present invention. Portions which are drawn by broken lines are meant to be formed on a second substrate surface (rear face). The detailed description of any portion that has an identical counterpart in Embodiment 1 will be omitted.

In the polarization switching/variable directivity antenna of Embodiment 2, every third slot 17*c* defining a polarization switching element 16 has a second slot (24*a* to 24*d*) of a directivity switching element 15 connected thereto, at an end that is not continuous with a first slot 17*a*. Moreover, a second polarization switching switch (26*a* to 26*d*) is connected at each position adjoining a second slot (24*a* to 24*d*), so as to bridge across the third slot 17*c*.

In Embodiment 2, the conditions which must be satisfied by the radiation element 13 and the polarization switching elements 16 are the same as those described in Embodiment 1. Similarly to Embodiment 1, by controlling the polarization switching switches 19*a* to 19*b*, the rotation direction of a circularly polarized wave can be switched.

In Embodiment 2, each directivity switching element 15 is composed of a loop-shaped second slot (24*a* to 24*d*) and a directivity switching switch (25*a* to 25*d*). The conditions to be satisfied by the second slots 24*a* to 24*d* of the directivity switching elements 15 and the directivity switching switches 25*a* to 25*d* are the same as those described in Embodiment 1. Similarly to Embodiment 1, by controlling the directivity switching switches 25*a* to 25*d*, the maximum gain direction can be switched into the direction in which a directivity switching element 15 exists.

In the antenna of Embodiment 2, a second polarization switching switch (26*a* to 26*d*) is connected at each position adjoining a second slot (24*a* to 24*d*), so as to bridge across the third slot 17*c*. By providing such second polarization switching switches 26*a* to 26*d*, it becomes possible to separate the polarization switching elements 16 from the directivity switching elements 15, whereby the effects provided by the polarization switching elements 16 and the effects provided by the directivity switching elements 15 can become clearer. However, as shown in FIG. 5B with reference to Embodiment 1, if the second polarization switching switches 26*a* to 26*d* were closed while the directivity switching switches 25*a* to 25*d* were open, circularly polarized waves having opposite rotation directions would be excited in the first slot 17*a* and the second slots 24*a* to 24*d*, thus deteriorating the axial ratio of the entire antenna of Example 2. Therefore, as shown in FIG. 5C, the second polarization switching switches 26*a* to 26*d* must also be left open when the directivity switching switches 25*a* to 25*d* of the directivity switching elements 15 are open.

Note that, as in Embodiment 1, a slot of any shape other than a square may be employed for each directivity switching element 15 and each polarization switching element 16.

Although the second slots 24*a* to 24*d* are deployed in four directions in Embodiment 2, any plural number of third slots 17*c* of polarization switching elements 16 may be provided, unless ξ equals 0°, 90°, 180°, or 270°. Thus, the maximum gain direction can be switched into as many directions as desired, so long as the second slots can be placed without overlap.

Example 2

Hereinafter, Example 2 of the present invention will be described. FIG. 10 shows a see-through view of a first substrate surface of an antenna of Example 2. The dielectric substrate 11 and the ground conductor plate 12 are similar to those of Example 1. One side of the first slot 17*a* has a length L1 of 23.0 mm, and the first slot 20*a* has a width w1 of 2.0 mm. One side of each second slot 24*a* to 24*d* has a length L2 of 23.0 mm, and each second slot 24*a* to 24*d* has a width w2 of 2.0 mm. One side of each third slot 17*c* has a length L3 of 10.0 mm, and each third slot 17*c* has a width w3 of 2.0 mm. In this case, the circular polarization index is 3.4. Moreover, as in Example 1, the directivity switching elements are allowed to function as directors.

FIGS. 11A, 11B, 11C, and 11D are diagrams showing examples of how the directivity switching switches 25*a* to 25*d*, the polarization switching switches 19*a* to 19*d*, and the second polarization switching switches 26*a* to 26*d* may be controlled in order to change the maximum gain direction. Similarly to Example 1, in FIGS. 11A to 11D, it is meant that black switches are in a conducting state, whereas white switches are in an open state.

Figure 11A:
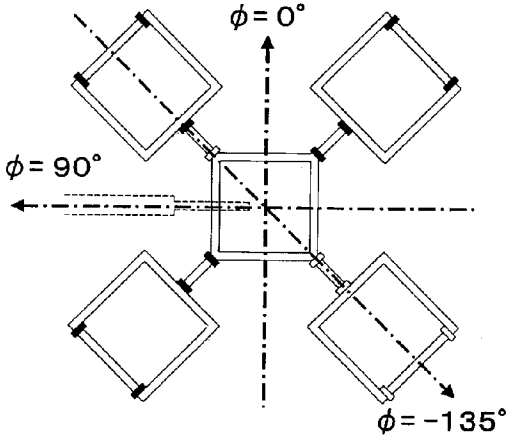
FIGS. 11A to 11D are diagrams showing examples of how switches of a polarization switching/variable directivity antenna according to Example 2 of the present invention may be controlled.
Figure 11B:
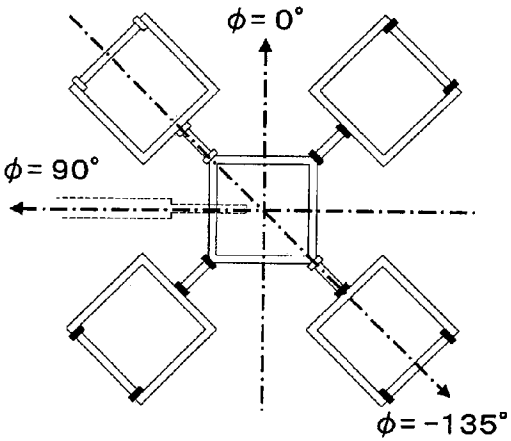
Figure 11C:
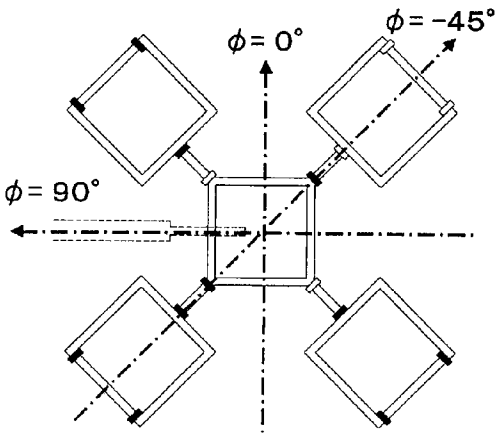
Figure 11D:
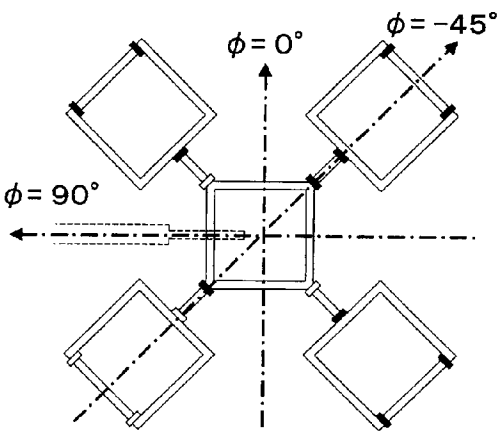
Figures 12A, 12B, 12C, 12D:
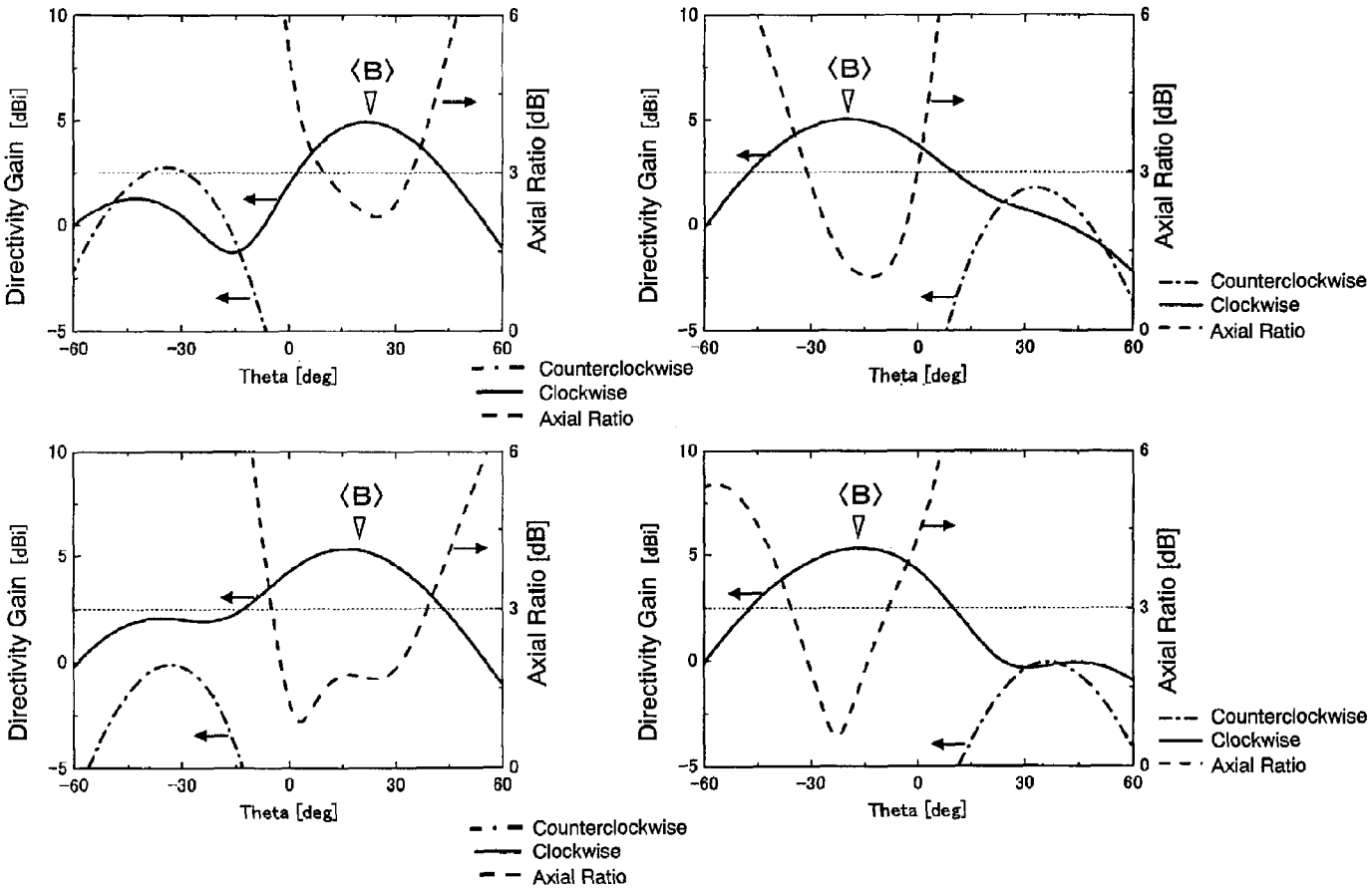
FIGS. 12A to 12D are graphs showing changes in radiation directivity of a polarization switching/variable directivity antenna according to Example 2 of the present invention.

FIGS. 12A, 12B, 12C, and 12D show the radiation directivity of the antenna of Example 2. FIGS. 12A, 12B, 12C, and 12D correspond to the states shown in FIGS. 11A, 11B, 11C, and 11D, respectively. FIGS. 12A and 12B each show a θ dependence of directivity gain on the ϕ=−135° plane, and FIGS. 12C and 12D each show a θ dependence of directivity gain on the ϕ=−45° plane.

As indicated by <B> in FIGS. 12A and 12B, by controlling the directivity switching switches 25*a* to 25*d*, the polarization switching switches 19*a* to 19*d*, and the second polarization switching switches 26*a* to 26*d* in a manner shown in FIGS. 11A and 11B, the maximum gain direction of a counterclockwise circular polarization component on the antenna was switched into the θ=+20° direction (FIG. 12A) or the θ=−20° direction (FIG. 12B) on the ϕ=−135° plane. Similarly, as indicated by <B> in FIGS. 12C and 12D, by controlling the directivity switching switches 25*a* to 25*d*, the polarization switching switches 19*a* to 19*d*, and the second polarization switching switches 26*a* to 26*d* in a manner shown in FIGS.

11C and 11D, the maximum gain direction was switched into the θ=+20° (FIG. 12C) or the θ=−20° direction (FIG. 12D) on the ϕ=−45° plane. At this time, under all conditions in FIGS. 12A, 12B, 12C, and 12D, an axial ratio of 3 dB or less was achieved in the maximum gain direction.

Figure 13B:
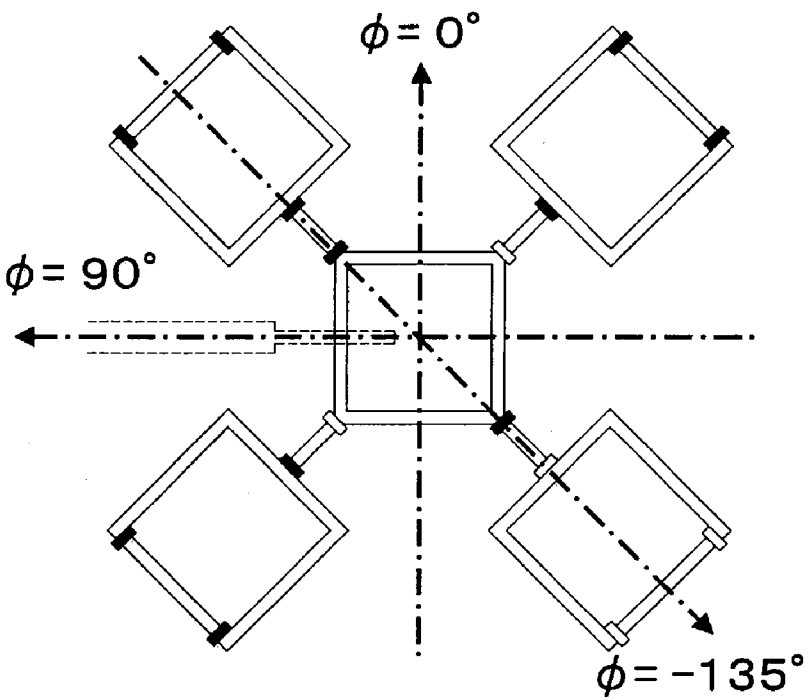
FIGS. 13A and 13B are diagrams showing examples of how switches of a polarization switching/variable directivity antenna according to Example 2 of the present invention may be controlled.
Figure 13A:
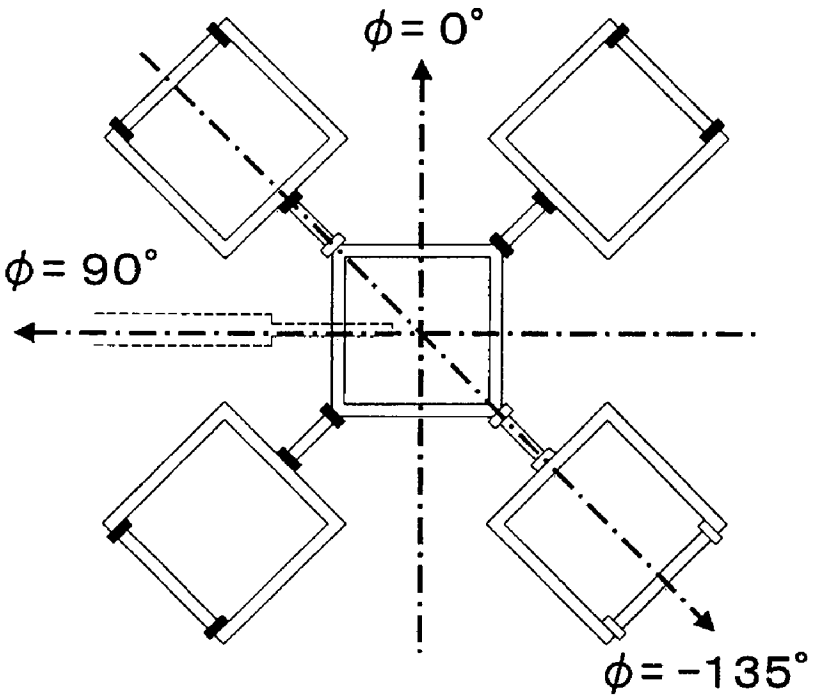
Figure 14A:
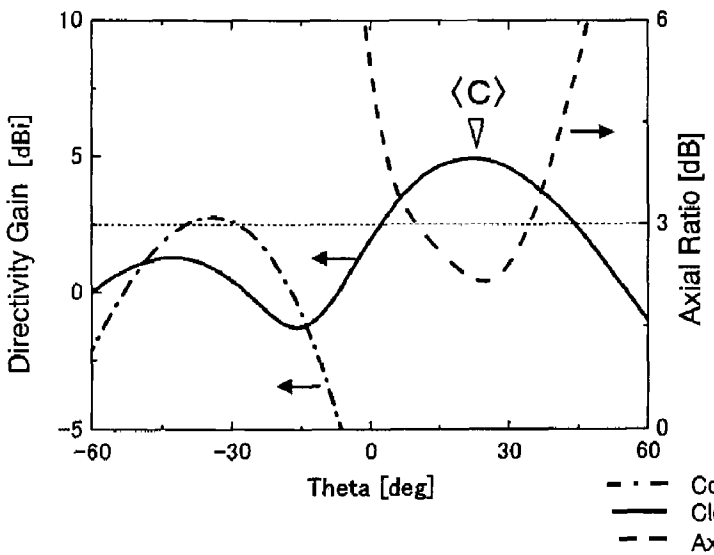
FIGS. 14A and 14B are graphs showing changes in radiation directivity of a polarization switching/variable directivity antenna according to Example 2 of the present invention.
Figure 14B:
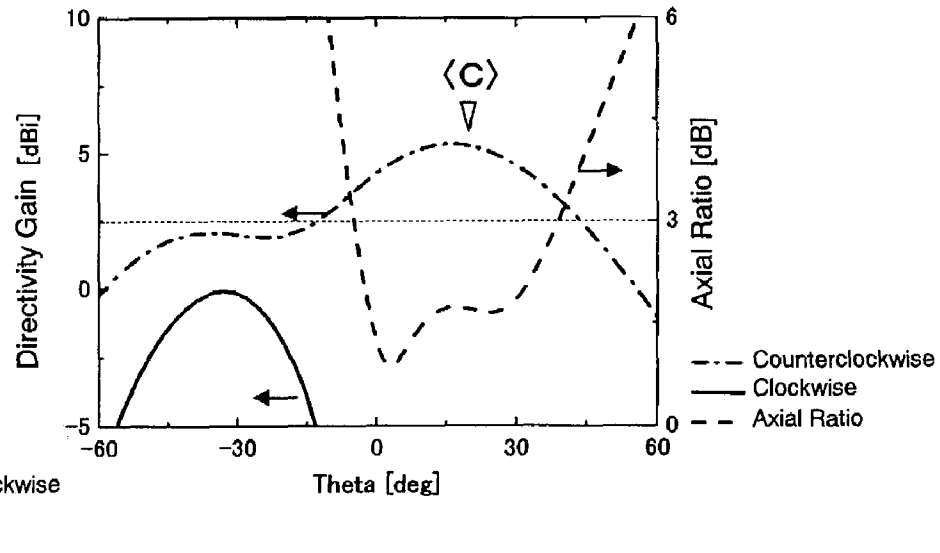
Figure 15A:
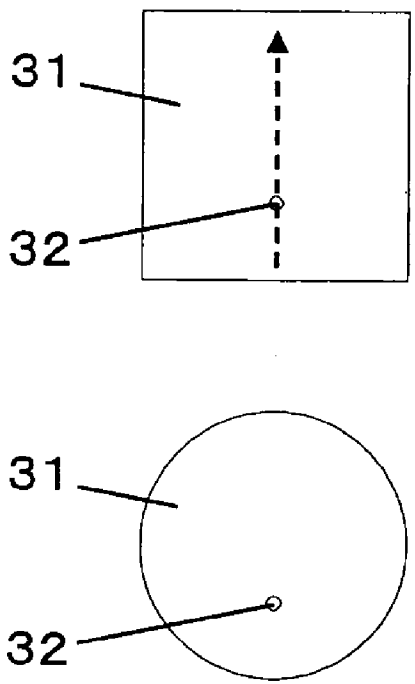
FIGS. 15A to 15C are diagrams showing structures of a generic linear antenna and generic circular polarization antennas.
Figure 15B:
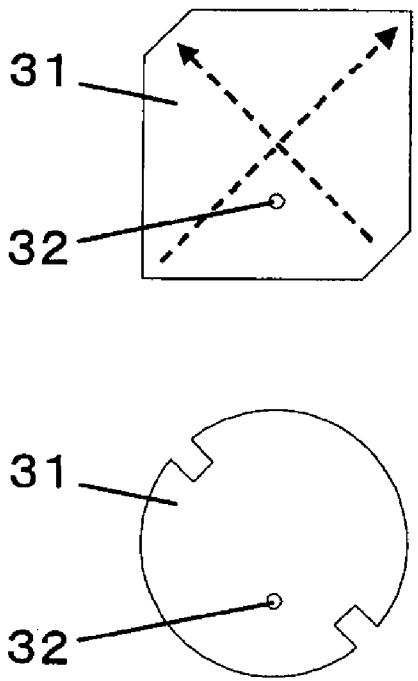
Figure 15C:
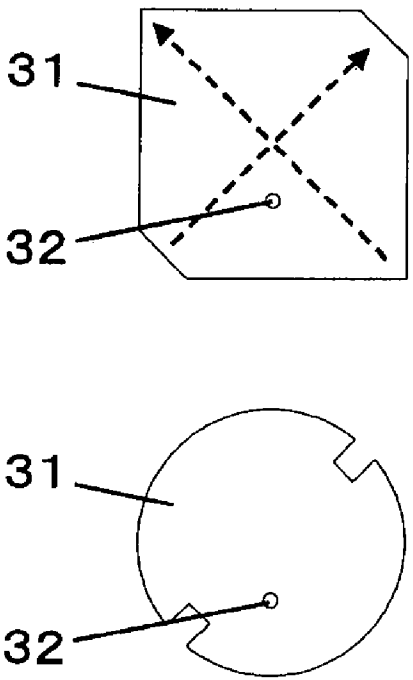
Figure 16B:
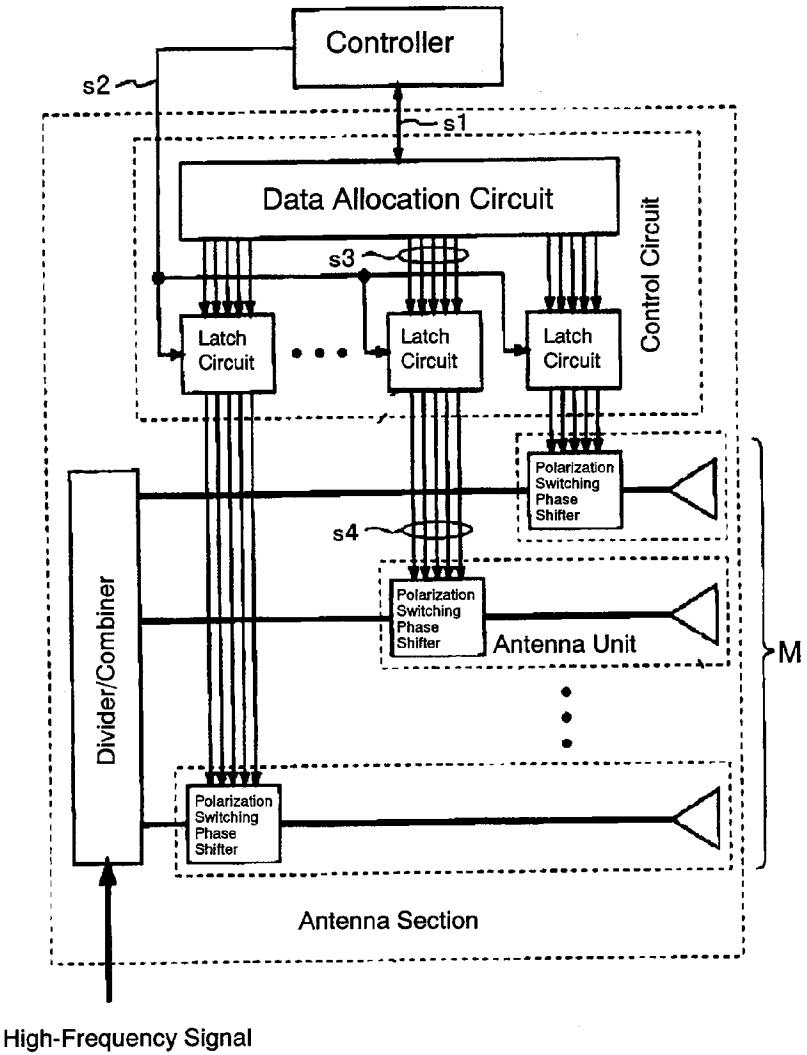
FIGS. 16A and 16B are schematic illustrations of a conventional circular polarization switching type-phased array antenna device.
Figure 16A:
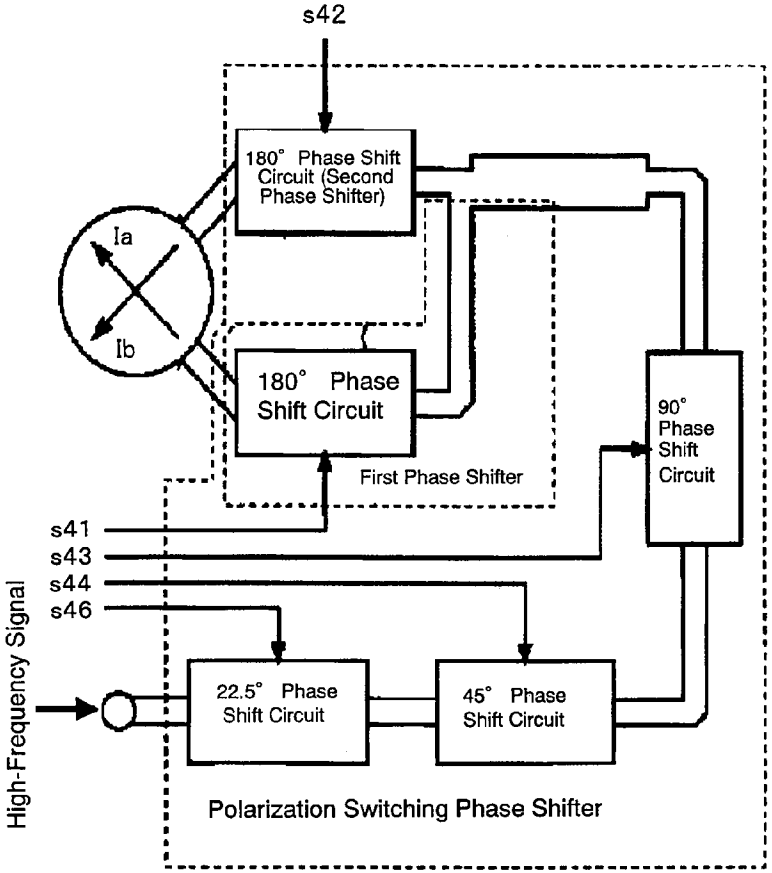

FIGS. 13A and 13B show examples of how the polarization switching switches 19*a* to 19*d* may be controlled. FIGS. 14A and 14B show θ dependences of directivity gain on the ϕ=−135° plane of the antennas shown in FIGS. 13A and 13B, respectively. As indicated by <C> in FIGS. 14A and 14B, by controlling the conducting and open states of the polarization switching switches 19*a* to 19*d*, the rotation direction of a circularly polarized wave was switched from counterclockwise to clockwise, without changing the maximum gain direction of radiation directivity.

Table 6 shows, when the directivity switching switches 25*a* to 25*d* and the polarization switching switches 19*a* to 19*d* are switched, the rotation directions of a circularly polarized wave and the maximum gain directions that are obtained in the respective operating states according to Example 2.

TABLE 6

| | directivity switching switch | | | | polarization switching switch | | | | rotation direction of circularly polarized wave | maximum gain direction | |
|---|---|---|---|---|---|---|---|---|---|---|---|
| | 25a | 25b | 25c | 25d | 19a | 19b | 19c | 19d | | ϕ [°] | θ [°] |
| 1 | con. | con. | open | con. | open | con. | open | con. | clockwise | −135 | 20 |
| 2 | open | con. | con. | con. | open | con. | open | con. | clockwise | 45 | 20 |
| 3 | open | con. | con. | open | open | con. | open | con. | clockwise | −45 | 20 |
| 4 | con. | open | con. | con. | open | con. | open | con. | clockwise | 135 | 20 |
| 5 | con. | con. | con. | con. | open | con. | open | con. | clockwise | 0 | 0 |
| 6 | con. | con. | open | con. | con. | open | con. | open | counter | −135 | 20 |
| 7 | open | con. | con. | con. | con. | open | con. | open | counter | 45 | 20 |
| 8 | open | con. | con. | open | con. | open | con. | open | counter | −45 | 20 |
| 9 | con. | open | con. | con. | con. | open | con. | open | counter | 135 | 20 |
| 10 | con. | con. | con. | con. | con. | open | con. | open | counter | 0 | 0 |

con. = conducting
counter = counterclockwise

As shown in Table 6, by controlling the directivity switching switches 25*a* to 25*d* and the polarization switching switches 19*a* to 19*d*, switching of the rotation direction of a circularly polarized wave and switching of the maximum gain direction into multiple directions are possible.

Thus, by adopting the above-described construction, an antenna was realized which is capable of switching the maximum gain direction into multiple directions, and at the same time switching the rotation direction of a circularly polarized wave in the maximum gain direction.

Despite its simple construction which does not require a plurality of phase shifters or require switching of feed lines, a polarization switching/variable directivity antenna according to the present invention is characterized by being able to simultaneously realize switching of the rotation direction of a circularly polarized wave and switching of the maximum gain direction of radiation directivity, and therefore is useful as an antenna for use in a mobile terminal device or the like. Moreover, the antenna is useful as: an on-vehicle antenna for ETC; a small receiving antenna for satellite broadcast, which currently performs transmission/reception by using circularly polarized waves; or as an antenna for the SDARS (Satellite Digital Audio Radio System), which requires ability to handle both polarizations of circular polarization and linear polarization. Furthermore, the antenna is useful as an antenna used for wireless power transmission.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A polarization switching/variable directivity antenna comprising:

a dielectric substrate;

a ground conductor plate formed on a surface of the dielectric substrate;

at least one radiation element provided within bounds of the ground conductor plate;

a feed member for the radiation element;

at least one directivity switching element provided on the ground conductor plate side of the dielectric substrate; and at least two polarization switching elements provided on the ground conductor plate side of the dielectric substrate, wherein, the at least one radiation element includes a first slot which is formed by removing a loop-like portion from the ground conductor plate, the first slot has a peripheral length which corresponds to one effective wavelength at an operating frequency, and the at least one radiation element is shaped so as to be axisymmetrical with respect to a line extending through a center of gravity of an internal conductor surrounded by the first slot and through a feed point, the feed point being a point where the feed member is in contact with the radiation element;

the at least one directivity switching element includes a second slot which is formed by removing a loop-like portion from the ground conductor plate, and at least two directivity switching switches each of which is connected so as to bridge between an internal conductor surrounded by the second slot and the ground conductor plate surrounding the second slot;

the second slot resonates at a frequency which is substantially equal to a resonant frequency of the first slot;

the second slot has a peripheral length which corresponds to one effective wavelength at the operating frequency;

the directivity switching switches are positioned so that, when the second slot is split into a plurality of slots in high-frequency terms by allowing all of the at least two directivity switching switches to conduct, the length of each slot having been split at both ends which are the at least two directivity switching switches is less than half the effective wavelength, or is greater than half the effective wavelength and yet less than one effective wavelength;

the at least two polarization switching elements each include a third slot which is formed by removing a linear-shaped portion from the ground conductor plate surrounding the first slot so as to be continuous with the first slot, and at least one polarization switching switch which is connected so as to bridge across the third slot, between portions of the ground conductor plate surrounding the third slot;

the circular polarization index Q0(Δs/s) has a value of no less than 2.2 and no more than 4.0, where Δs is an area of the third slot or third slots coupling to the first slot when a corresponding polarization switching switch or polarization switching switches are opened; s is an area of a slot portion of the first slot; and Q0 is an unloaded Q of the first slot;

with respect to an angle ξ between a line extending through the center of gravity of the internal conductor surrounded by the first slot and through the feed point and a line extending through the center of gravity of the internal conductor surrounded by the first slot and through a branch point at which each third slot branches out from the first slot, one third slot of the at least two polarization switching elements is provided so as to satisfy either a range of 0°<ξ<90° or a range of 180°<ξ<270°, and another third slot of the at least two polarization switching elements is provided so as to satisfy either a range of 90°<ξ<180° or a range of 270°<ξ360°; and the second slot is continuous with the first slot via a third slot.

2. The polarization switching/variable directivity antenna of claim 1, wherein the circular polarization index Q0(Δs/s) is no less than 2.7 and no more than 3.2.

3. The polarization switching/variable directivity antenna of claim 1, wherein every third slot defining the at least two polarization switching elements is continuous with a second slot of the at least one directivity switching element.

* * * * *